United States Patent [19]

Boitz

[11] 4,184,666

[45] Jan. 22, 1980

[54] FLEXIBLE PIPE VICE FOR USE WITH A LADDER

[76] Inventor: Robert R. Boitz, Box 346, Lincoln City, Oreg. 97367

[21] Appl. No.: 908,759

[22] Filed: May 23, 1978

[51] Int. Cl.[2] ..... B25B 13/52

[52] U.S. Cl. ..... 269/98; 269/95; 269/130; 269/321 N

[58] Field of Search ..... 269/130–132, 269/95, 97–98, 321 N, 1

[56] References Cited

U.S. PATENT DOCUMENTS 1,931,934 10/1933 Norman ..... 269/98

*Primary Examiner*—Robert C. Watson

*Attorney, Agent, or Firm*—Howard I. Podell

[57] ABSTRACT

A flexible pipe vice having a V-shaped pipe rest attached by side bars to a second bar which can be positioned on a ladder step, a set of chains is also attached to the pipe rest and can be wrapped around a step of a ladder and a piece of pipe positioned in the pipe rest. A first bar attached to a distal end of the chains can be held by a user's foot to secure the pipe in the pipe rest on the step of the ladder.

6 Claims, 3 Drawing Figures

FLEXIBLE PIPE VICE FOR USE WITH A LADDER

I have invented a new and novel flexible pipe vice for use with a ladder. My device can be used for holding pipes or flexible tubing up to approximately ½ inch to two inches in diameter. A plumber or similar worker can conveniently use a hack saw or other implement to cut or otherwise work on a round work piece with this device. A regular work bench is not required and a step of a ladder or a saw horse can serve as a work support using this improved device. Where desired or necessary, a C clamp or vice grip can be attached to the second bar for additional strength and securing the vice to the support. When used on a ladder step, the ladder is still useable while the vice is attachable to the ladder. Furthermore, an additional adaptor can be attached to a front lip of this vice to use this vice with a large work piece.

This improved vice uses a V shaped pipe rest with side bars and a second bar connected by a chain wrapped around the work piece and held over the work piece by a foot of the user to secure the pipe or other work piece while the pipe is being worked on.

My invention can be understood in view of the accompanying figures.

Figure 1:
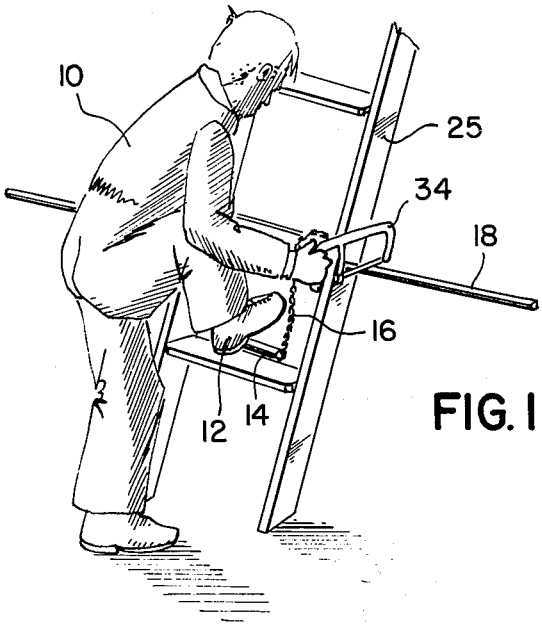
FIG. 1 is a perspective view of the device in use.
Figure 2:
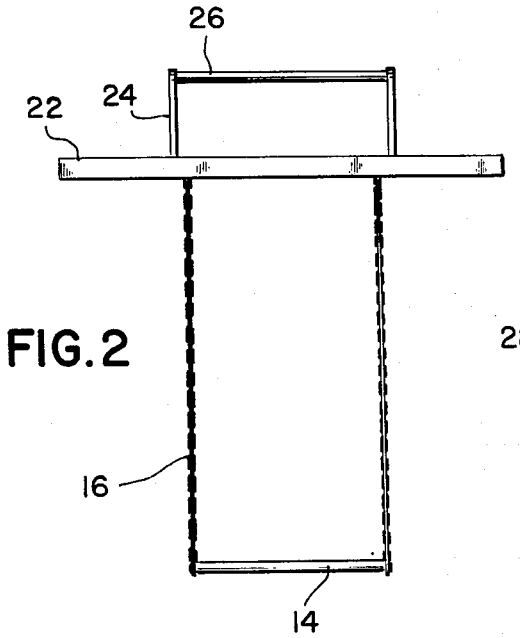
FIG. 2 is a front view of the device in the opened configuration.
Figure 3:
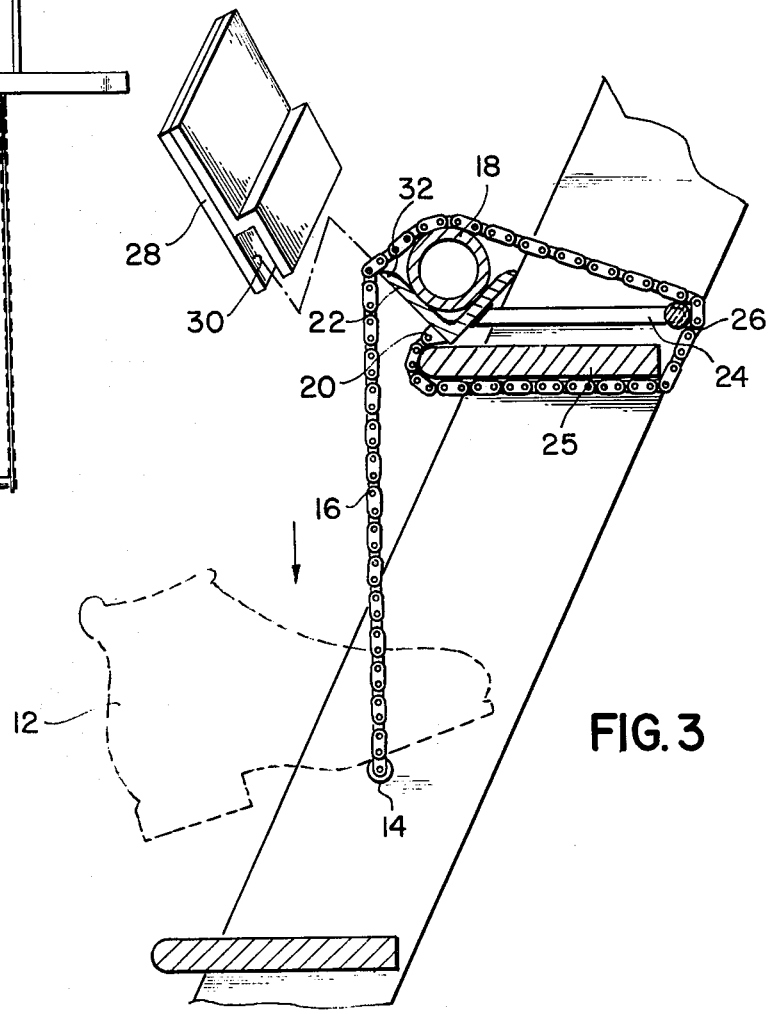
FIG. 3 is a side view in cross section of the device in use with the adaptor about to be positioned on the pipe rest.

With regard to FIGS. 1, 2, and 3, a man 10 can rest his foot 12 on a first bar 14 which is connected by a chain 16 passing over a work piece 18 and connected to a set of tabs 20. The tabs 20 are attached to a front bottom portion of a V shaped pipe rest 22 which is connected by a set of side bars 24 to a second bar 26. The chain 16 passes over the second bar 26 and over the work piece 18 so that the vice can be secured to a step of the ladder 25. An additional adaptor for larger pipes 28 has a channel 30 which engages the front lip 32 of the V shaped pipe rest 22 so that a work piece larger than the pipe 18 seen in the illustration can be used in this vice.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A pipe vice, comprising:

a base, a chain attached to the base, and means of engaging the chain to the work piece and to a support, further comprising:

a first bar attached to a distal end of the chain to hold the work piece to the base, and the base to a support, said bar of a size and shape to be engaged by a foot of the user so as to apply tension to the chain for holding the work piece to the base and the base to a support.

2. The pipe vice of claim 1, wherein two side bars are attached to the base, a second bar is attached to a distal end of the sidebars, the chain is attached to a tab, the tab is attached to the base, a second chain is attached to the first bar and to a second tab, and the second tab is attached to another side of the base.

3. The pipe vice of claim 2, wherein the base is a V shaped pipe rest.

4. The pipe vice of claim 3, further comprising: an adapter removeably attachable to a front lip of the V shaped pipe rack.

5. The pipe vice of claim 4, wherein the adapter has a channel in a front portion of the adapter to engage the front lip of the pipe rest.

6. The pipe vice of claim 5, wherein the support is a step of a ladder.

* * * * *